US006252187B1

(12) United States Patent
Dannenberg

(10) Patent No.: US 6,252,187 B1
(45) Date of Patent: Jun. 26, 2001

(54) LINK SWITCH

(75) Inventor: Patrick Dannenberg, Brookvale (AU)

(73) Assignee: Tappat Engineering PTY Ltd., Brookvale (AU)

( * ) Notice: Subject to any disclaimer, the term of this patent is extended or adjusted under 35 U.S.C. 154(b) by 0 days.

(21) Appl. No.: 09/462,518

(22) PCT Filed: Jul. 10, 1998

(86) PCT No.: PCT/AU98/00537

§ 371 Date: Jan. 7, 2000

§ 102(e) Date: Jan. 7, 2000

(87) PCT Pub. No.: WO99/03180

PCT Pub. Date: Jan. 21, 1999

(30) Foreign Application Priority Data

Jul. 10, 1999 (AU) ..... PO7832

(51) Int. Cl.[7] ..... H01R 33/955; H01R 13/70

(52) U.S. Cl. ..... 200/51.14; 200/51 R; 200/51.17; 200/17 R

(58) Field of Search ..... 200/1 R, 12 R, 200/43.01, 43.04, 43.05, 43.11, 50.01, 50.06, 50.09, 51 R, 51.05, 51.12, 51.14, 51.17, 284

(56) References Cited

U.S. PATENT DOCUMENTS

| | | | | |
|---|---|---|---|---|
| 2,805,294 | | 9/1957 | Edmunds | 317/112 |
| 3,343,042 | | 9/1967 | Cellerini et al. | 317/112 |
| 3,605,064 | * | 9/1971 | Routh | 339/21 R |
| 4,069,403 | * | 1/1978 | Beaudette et al. | 200/51.12 |
| 4,481,388 | * | 11/1984 | Gillam et al. | 200/51 R |
| 4,531,174 | | 7/1985 | Rickmann | 361/339 |
| 5,334,808 | | 8/1994 | Bur et al. | 200/50 AA |
| 5,406,449 | * | 4/1995 | Hicks et al. | 361/616 |
| 5,828,017 | * | 10/1998 | Fiorini et al. | 200/17 R |
| 5,847,338 | * | 12/1998 | Kuki et al. | 200/17 R |

FOREIGN PATENT DOCUMENTS

| | | | |
|---|---|---|---|
| 0 127 298 | 12/1984 | (EP) | H02B/11/00 |
| 0 411 871 | 2/1991 | (EP) | H01H/71/10 |
| 9-074627 | 3/1997 | (JP) | H02B/11/173 |

* cited by examiner

*Primary Examiner*—Michael Friedhofer
(74) *Attorney, Agent, or Firm*—Merchant & Gould P.C.

(57) ABSTRACT

A link switch for completing an electrical connection between at least two cables comprising: first and second conductive clamping portions for clamping the ends of the cables, the conductive clamping portions having mating surfaces for the reception of a switch completion unit between the conductive clamping portions; a switch completion unit including at least one conductive portion for mating with the mating surfaces and a pressure application means for applying pressure to the conductive portions to lock the conductive portion in contact with the conductive clamping portions.

14 Claims, 3 Drawing Sheets

LINK SWITCH

FIELD OF THE INVENTION

The present invention relates to the field of electrical switches and in particular discloses a new form of conveniently operated link switch for high current power supplies.

BACKGROUND OF THE INVENTION

Link switches for voltage power supplies and cabling are well known. A power line can carry a large amount of current and it is necessary to ensure proper switching or interconnection between two power cables. In particular, compact operation of an open point link switch is highly desirable. Prior art switches have a number of significant disadvantages. Firstly, they are often unduly large thereby taking up excessive space especially where space, is a premium. Additionally, they often involve the necessity to access live components which results in the resulting danger of possible electrocution. Electrical switches are further often able to be tampered with and the degree of contact interconnection can be highly variable.

SUMMARY OF THE INVENTION

It is an object of the present invention to provide a superior form of compact open point link switch suitable for use with electric power supply lines.

In accordance with the first aspect of the present invention there is provided a link switch for completing an electrical connection between two cables comprising:

first and second conductive clamping portions for clamping the ends of the cables, the conductive clamping portions having a mating surfaces for the reception of a switch completion unit between the conductive clamping portions;

a switch completion unit including at least one conductive portion for mating with the mating surface and a pressure application means for applying pressure to the conductive portion to lock the conductive portion in contact with the conductive clamping portions;

Further, the conductive clamping portions can include a series of initial contact surfaces which make initial contact with a mating initial surface of the switch completion unit, the initial surfaces being different from the mating surfaces such that initial contact is made in a subsequently inoperative surface of the switch completion unit.

Preferably the switch completion unit is slidable into and out of an aperture defined by the conductive clamping portions and includes a cam locking unit for providing a cam lock of the conductive portion in contact with the conductive clamping portions. The switch completion unit preferably includes a detachable handle utilised in the operation of the switch which is detachable only when the switch completion unit is in a locked position.

The switch unit conductive portions can be shaped to provide a point contact with the conductive clamping portions and can include a generally planar surface having protuberances at extremities thereof.

Preferably, the number of conductive clamping portions is two and the cables are clamped to the conductive clamping portions in a spaced apart substantially parallel manner. Ideally, the clamping portions are adapted to be interchangeable so as to clamp a series of differently surface profiled cable ends and the clamping portions can include a resilient clamping means for resiliently clamping the cables to the conductive clamping portions. The cam lock can include a profiled surface that, upon rotation of the cam lock in a first direction, the profiled surface exerts an increasing pressure on the conductive portions to a limit position prescribed by an interlocking ball and socket arrangement.

BRIEF DESCRIPTION OF THE DRAWINGS

Notwithstanding any other forms which may fall within the scope of the present invention, preferred forms of the invention will now be described, by way of example only, with reference to the accompanying drawings in which.

DESCRIPTION OF PREFERRED AND OTHER EMBODIMENTS

The preferred embodiment comprises a switch having a detachable switching mechanism that can be inserted and actuated so as to complete a current circuit. Further, the switch also includes a detachable handle for activating the switch via a locking means.

Figure 1:
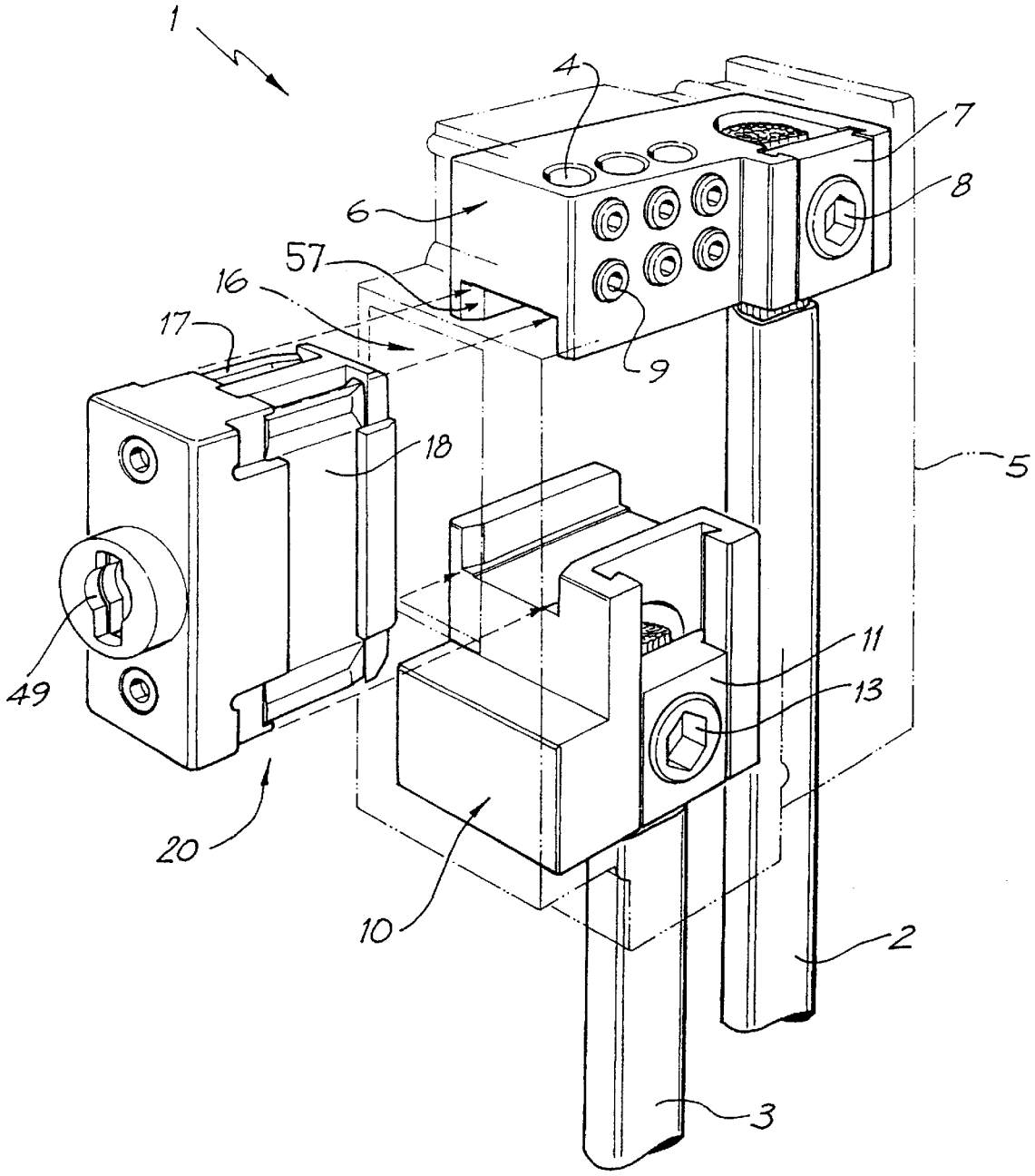
FIG. 1 is an exploded perspective view of a first portion of the switch of the preferred embodiment and in particular it shows the conductive portions of the switch.
Figure 2:
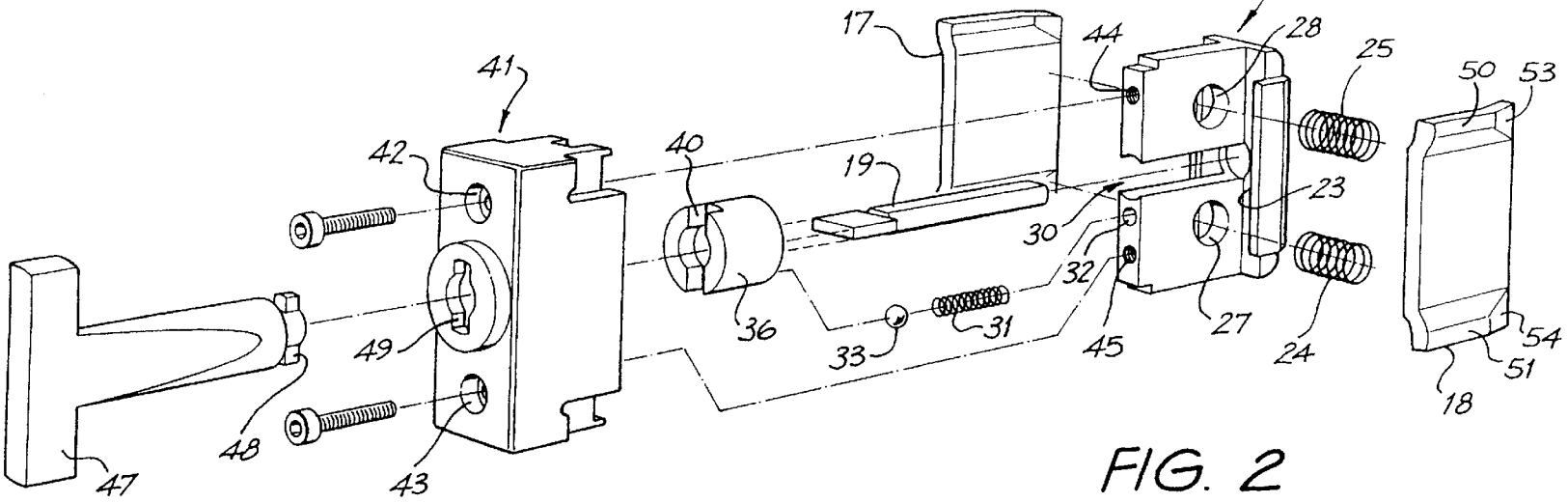
FIG. 2 illustrates an exploded perspective of the handle unit of FIG. 1 for insertion into the switch of the preferred embodiment.

Turning now to FIG. 1, there is illustrated the electrically conductive components of the switch 1 which interconnects two cables to 2, 3. The cable 2 is inserted through an outer polycarbonate covering portion 5 (shown in phantom) and is clamped between the metal block portion 6 and a dovetail block 7 by means of screw bolt B. The block portion 6 includes a series of holes e.g. 4 for the insertion of a small conductor wires for "tapping off" of power from the switch 1. The conductor wires are fixed within holes 4 by means of screw bolts e.g. 9. The second cable 3 is inserted through an aperture in the case portion 5 and is clamped between conductive block portion 10, and dovetail portion 11 with again the portions being clamped together by means of screw bolt 13. Two metal leaf portions 17, 18 which are contained within a handle switch portion 20, which itself will be further described hereinafter with reference to FIG. 2, are inserted in an aperture 16 in the outer casing 5 and mate with mating portions of the conductive blocks 6, 10 so as to form an electrical interconnection on demand. The two portions 17, 18 are forced apart by means of cam portion, which is activated by a handle so as to lock the two portions 17, 18 firmly against corresponding portions of the conductive blocks 6, 10.

Turning now to FIG. 2, there is illustrated 20 an exploded perspective view of the handle portion utilised to activate the switch. The handle portion includes the previously mentioned metal leaf portions 17, 18 which are inserted in a corresponding mating groove within plastic former 22. The leaf portion 18 being inserted in groove 23. The two leaf portions are resiliently held apart by means of springs 24, 25 which act to resiliently push the leaf portions 17, 18 apart within their corresponding grooves. The spring portions 24, 25 are inserted through holes 27, 28 in plastic former 22. The copper portion 19 is inserted in a cylindrically aperture 30 within former 22. Spring 31 is inserted in aperture 32 and ball portion 33 is placed upon one end of spring portion 31.

Figure 2A:
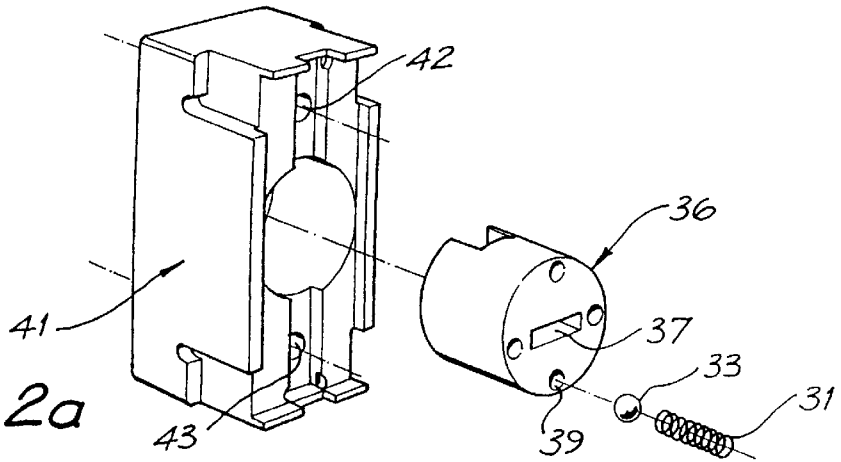
FIG. 2*a* illustrates a second perspective view of portions of the handle unit of FIG. 2.

One end of conductive portion 19 mates with plastic unit 36 which has an end face as illustrated in FIG. 2*a* which includes slot 37 and a series of holes e.g. 39 which mate with ball 33, the plastic unit 36 being generally rotatable by means of slots 40. The plastic unit 36 is inserted in top plastic former unit 41 which is designed to mate with the rest of the handle portion 20 with screw holes 42, 43 mating with corresponding screw holes 44, 45 in plastic former 22 so as to provide for screws to lock the pieces together.

A plastic handle 47, having end mating portion 48, is designed to be inserted through slot 49 so as to engage plastic locking unit 36 and thereby rotate metal unit 19 forcing the two leafed portions 17, 18 apart in accordance with the requirement of ensuring good electrical contact between surfaces. The unit 19 includes a cam surface such that when the two portions 17, 18 are forced apart the cam surface interacts with ball 33 and holes 39 to lock the unit 19 in one of two positions such that the handle 47 can only be rotated 90° between, the two positions each of which corresponds to a mating of ball 33 with a hole 39.

Hence, the handle unit 20 is designed to be inserted through aperture 16 of FIG. 1 with the leaf portions 17, 18 being placed between corresponding mating portions 6, 10. Subsequently, the handle 47 is rotated thereby providing a camlocking arrangement of the two leaf portions 17, 18, firmly pressing them in electrical contact with the corresponding block portions. The handle 47 is then removed thereby providing a tamper proof switch connection between the two wires 2, 3 on demand.

When subsequent deactivation of the switch is required, the handle portion 47 can be inserted within slot 49 and the handle rotated and the whole of the handle unit 20 removed from the plastic case 5.

The preferred embodiment further includes the advantageous feature that the two leafed portions 17, 18 have raised end protuberances e.g. 50, 51 which form the electrical contact with the corresponding metal block portions 6, 10. As a point contact is made, possibilities of welding surfaces during catastrophic failure are substantially reduced. Preferably, the leafed portions e.g. 17, 18 further include bevelled edges 53, 54 so as to reduce the problems associated with insertion and arcing within the metal portion 6, 10. Hence, the bevelled surfaces 53, 54 first form conductive contact with corresponding mating surfaces e.g. 57 (FIG. 1) on the surface of blocks 6, 10 such that any initial arcing is across these surfaces and not across the primary contact surfaces 50, 51. These leads to improved long term conductivity.

The foregoing arrangement provides an extremely compact and slim connector which can be packaged alongside other connectors where three phase-power is required. The two parallel cables can be closely packaged next to one another in any linked switch arrangement. The holes 39 provide a snap fit for plastic element 36 which results in handle 47 being snapped into one of a predetermined number of places. This assists in ensuring continued proper operation of the switch 20.

Figure 3:
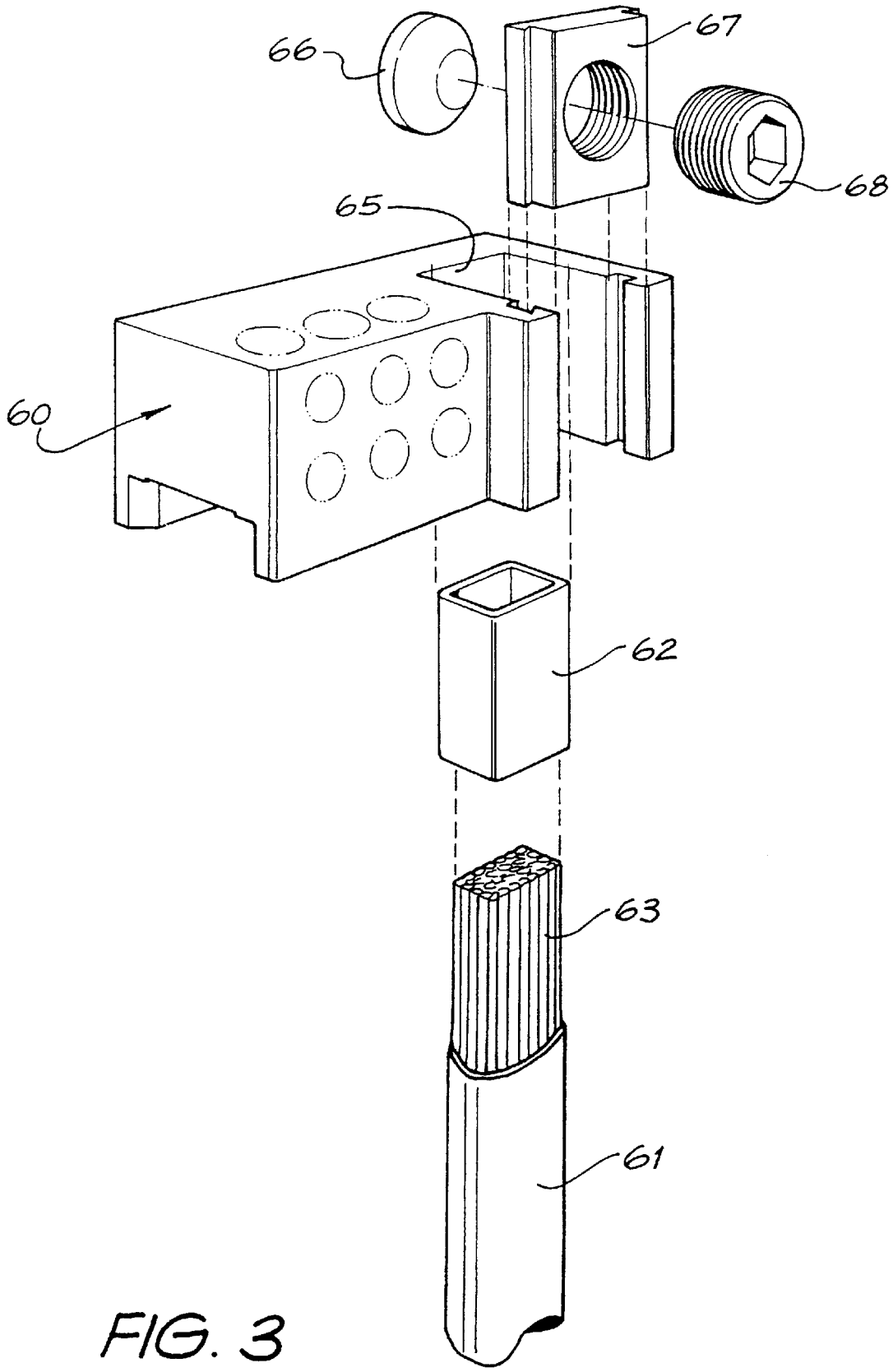
FIG. 3 is a perspective view of an alternative block arrangement.

Of course, other arrangements are possible. The metal blocks 6, 10 can be adapted to fit different cable types depending on conditions. For example, it is often necessary to prevent oxidisation of aluminium cables and to ensure compatible metal materials are utilised in switch. Hence, the blocks 6, 10 can be adapted for different cable types. For example, as shown in FIG. 3, there is illustrated an alternative form of block 60 which is adapted to receive a cable 61 which has been crimped utilising a tin plated brass ferrule 62 such that the crimping forms a general tight compaction of the aluminium strands 63 of cable 61. The crimping and compacting of the aluminium strands leads to a positive transition locking out the opportunity for oxidation. The generally rectangular cross-section of ferrule 62 is designed to mate with the surface of metal block 60 and to be clamped in a resilient manner against the surface 65 by means of a belleville washer 66 which is forced against the ferrule 62 by means of dovetail element 67 and screw bolt 68. The belleville washer 66 acts to resiliently compress the aluminium cable so as to ensure that any creep in the aluminium does not become a problem. Further, the ferrule 62 is preferably coated with an anti-oxidising agent such as alminox which assists in eliminating moisture oxidisation from the aluminium cable. The ferrule 62 can further comprise a tin-plated brass or copper element.

Hence, it will be readily evident that the preferred embodiment can be readily adapted so as to provide for different types and sized cables depending on the cables utilised in any particular area.

It would be appreciated by a person skilled in the art that numerous variations and/or modifications may be made to the present invention as shown in the specific embodiment without departing from the spirit or scope of the invention as broadly described. The present embodiment is, therefore, to be considered in all respects to be illustrative and not restrictive.

We claim:

1. A link switch for completing an electrical connection between at least two cables comprising:

first and second conductive clamping portions for clamping the ends of said cables, said conductive clamping portions having a mating surfaces for the reception of a switch completion unit between said conductive clamping portions;

the switch completion unit including at least one conductive portion for mating with said mating surfaces and a pressure application means for applying pressure to said at least one conductive portion to lock said at least one conductive portion in contact with said conductive clamping portions.

2. A link switch as claimed in claim 1 wherein said switch completion unit is slidable into and out of an aperture defined by said conductive clamping portions.

3. A link switch as claimed in any previous claim wherein said switch completion unit includes a cam locking unit for providing a cam lock of said conductive portion in contact with said conductive clamping portions.

4. A link switch as claimed in claim 3 wherein said cam lock includes a profiled surface that, upon rotation of said cam lock in a first direction, said surface exerts an increasing pressure on said conductive portions to a limit position prescribed by an interlocking ball and socket arrangement.

5. A link switch as claimed in any previous claim wherein said switch completion unit includes a detachable handle utilised in the operation of said switch.

6. A link switch as claimed in claim 5 wherein said handle is detachable only when said switch completion unit is in a locked position.

7. A link switch as claimed in any previous claim wherein the number of said at least one switch unit conductive portions is two and said pressure application means is located between said switch unit conductive portions as to force them apart.

8. A link switch as claimed in claim 7, wherein said switch unit conductive portions are shaped to provide a point contact with said conductive clamping portions.

9. A link switch as claimed in any previous claim wherein said switch unit conductive portions include a generally planar surface having protuberances at extremities thereof.

10. A link switch as claimed in any previous claim wherein the number of said conductive clamping portions is two and said cables are clamped to said conductive clamping portions in a spaced apart substantially parallel manner.

11. A link switch as claimed in any previous claim wherein said clamping portions are interchangeable so as to clamp a series of differently surface profiled cable ends.

12. A link switch as claimed in any previous claim wherein said clamping portions include a resilient clamping means for resiliently clamping said cables to said conductive clamping portions.

13. A link switch as claimed in claim 12 wherein said resilient clamping means includes a belleville washer urged against each of said cables.

14. A link switch as claimed in any previous claim wherein each of said conductive clamping portions includes a series of initial contact surfaces which make initial contact with a mating initial surface of said switch completion unit, said initial contact surfaces being different from said mating surfaces such that initial contact is made in a subsequently inoperative surface of said switch completion unit.

* * * * *